US007934714B2

(12) United States Patent
Ichihashi et al.

(10) Patent No.: US 7,934,714 B2
(45) Date of Patent: May 3, 2011

(54) SHEET POST-PROCESSING APPARATUS, IMAGE FORMING APPARATUS, AND IMAGE FORMING SYSTEM

(75) Inventors: Ichiro Ichihashi, Aichi (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Makoto Hidaka, Tokyo (JP); Hitoshi Hattori, Tokyo (JP); Junichi Tokita, Kanagawa (JP); Akira Kunieda, Tokyo (JP); Hiroshi Maeda, Aichi (JP); Tomoichi Nomura, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 394 days.

(21) Appl. No.: 12/216,481

(22) Filed: Jul. 7, 2008

(65) Prior Publication Data

US 2009/0014949 A1 Jan. 15, 2009

(30) Foreign Application Priority Data

Jul. 11, 2007 (JP) ..... 2007-182489
Mar. 6, 2008 (JP) ..... 2008-057040

(51) Int. Cl.
*B65H 37/04* (2006.01)

(52) U.S. Cl. ..... 270/58.17; 270/58.07; 270/58.11; 270/58.12; 270/58.27

(58) Field of Classification Search ..... 270/58.01, 270/58.07, 58.08, 58.09, 58.11, 58.12, 58.17, 270/58.27

See application file for complete search history.

(56) References Cited

U.S. PATENT DOCUMENTS

| | | | | |
|---|---|---|---|---|
| 7,568,686 | B2 * | 8/2009 | Terao et al. | 270/58.07 |
| 2006/0261544 | A1 | 11/2006 | Tamura et al. | |
| 2007/0063410 | A1 * | 3/2007 | Terao et al. | 270/58.09 |
| 2007/0063413 | A1 * | 3/2007 | Terao et al. | 270/58.12 |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |
| 2008/0099974 | A1 * | 5/2008 | Nomura et al. | 270/58.12 |
| 2008/0179809 | A1 * | 7/2008 | Kikkawa et al. | 270/58.11 |
| 2009/0014939 | A1 * | 1/2009 | Ichihashi et al. | 271/3.02 |

FOREIGN PATENT DOCUMENTS

| | | |
|---|---|---|
| JP | 08-137151 | 5/1996 |
| JP | 3615360 | 11/2004 |
| JP | 3667492 | 4/2005 |

OTHER PUBLICATIONS

Abstract of JP 11-060038 published Mar. 2, 1999.
Abstract of JP 10-059610 published Mar. 3, 1998.

* cited by examiner

*Primary Examiner* — Gene Crawford
*Assistant Examiner* — Leslie A Nicholson, III
(74) *Attorney, Agent, or Firm* — Harness, Dickey & Pierce, P.L.C.

(57) ABSTRACT

A sheet post-processing apparatus includes a sheet stacking unit, a moving member, and a discharging member. The moving member moves up the pile stacked on the sheet stacking unit to one of a plurality of scooping positions, and the discharging member receives the pile from the moving member at the one of the scooping positions and scoops up the pile by supporting a bottom edge of the pile for discharging the pile out of the sheet stacking unit.

15 Claims, 7 Drawing Sheets

SHEET POST-PROCESSING APPARATUS, IMAGE FORMING APPARATUS, AND IMAGE FORMING SYSTEM

CROSS-REFERENCE TO RELATED APPLICATIONS

The present application claims priority to and incorporates by reference the entire contents of Japanese priority documents 2007-182489 filed in Japan on Jul. 11, 2007 and 2008-057040 filed in Japan on Mar. 6, 2008.

BACKGROUND OF THE INVENTION

1. Field of the Invention

The present invention relates to a sheet post-processing apparatus, an image forming apparatus, and an image forming system including the sheet post-processing apparatus and the image forming apparatus.

2. Description of the Related Art

A sheet post-processing apparatus is widely used for performing post-processing, such as sorting, stapling, or stacking of sheets (printing sheets) received from an image forming apparatus, such as a copy machine or a printer. The sheet post-processing apparatus is, for example, a sorter or a finisher. The sheet post-processing apparatus is arranged downstream of the image forming apparatus.

For example, in Japanese Patent Application Laid-open No. H10-059610 and Japanese Patent Application Laid-open No. H11-060038, technologies of such a sheet post-processing apparatus are disclosed in which a plurality of sheets conveyed to a staple tray in the sheet post-processing apparatus is aligned in a conveying direction by putting an edge of each of the sheets in contact with a rear-end fence arranged on a lower portion of the staple tray, and a discharging claw then directly scoops up the pile by supporting an edge of a pile of the sheets, thereby discharging the pile out of the staple tray.

In Japanese Patent Application Laid-open No. H10-059610, the pile of the aligned sheets is directly scooped by the discharging claw, and is discharged out of the staple tray. In Japanese Patent Application Laid-open No. H11-060038, the discharging claw is moved to a position near the pile, and stands by at that position. The discharging claw is then moved to a corresponding scooping position to directly scoop up the pile, thereby discharging the pile out of the staple tray.

In the conventional technologies, however, especially, when a plurality of Z-folded sheets is conveyed to the staple tray, a folded portion of each of the Z-folded sheets interferes with the rear-end fence arranged at the lower portion of the staple tray. Therefore, it is difficult to align the Z-folded sheets on the staple tray.

SUMMARY OF THE INVENTION

It is an object of the present invention to at least partially solve the problems in the conventional technology.

According to an aspect of the present invention, there is provided a sheet post-processing apparatus that includes a sheet stacking unit that receives a plurality of sheets from an upstream apparatus and stacks the sheets in a pile thereon; a moving member that moves up the pile stacked on the sheet stacking unit to one of a plurality of scooping positions; and a discharging member that receives the pile from the moving member at the one of the scooping positions and scoops up the pile by supporting a bottom edge of the pile for discharging the pile out of the sheet stacking unit.

According to another aspect of the present invention, there is provided an image forming apparatus that is configured to be attached to the above sheet post-processing apparatus.

According to still another aspect of the present invention, there is provided an image forming system that includes the above image forming apparatus; and the above sheet post-processing apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
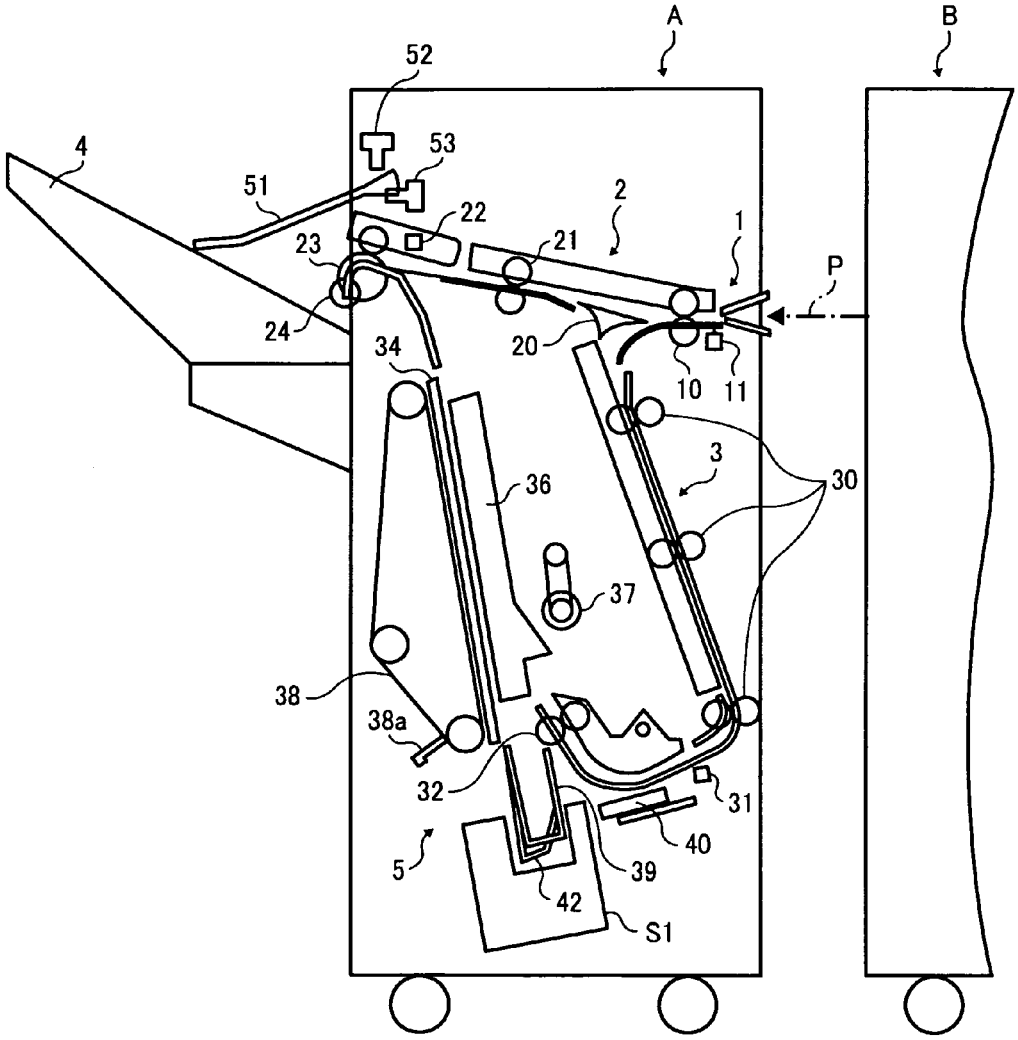
FIG. 1 is a schematic diagram of a sheet post-processing apparatus according to an embodiment of the present invention.

FIG. 1 is a schematic diagram of a sheet post-processing apparatus A according to an embodiment of the present invention. The sheet processing device A includes a guide path 1, an upper conveying path 2, and a lower conveying path 3. The guide path 1 receives a sheet P that is discharged out of an image forming apparatus B. The upper conveying path 2 and the lower conveying path 3 are branched from the guide path 1. The upper conveying path 2 extends toward a catch tray 4. The lower conveying path 3 is arranged for a stapling process.

The sheet post-processing apparatus A and the image forming apparatus B configure an image forming (processing) system. When the image forming apparatus B starts performing an image forming operation, the catch tray 4 is moved to a predetermined level. When it is determined that the catch tray 4 is positioned at the level such that the catch tray 4 is full of the stacked sheets P, a control unit (not shown) stops the image forming system from performing the image forming operation.

A guide roller 10 and an entrance sensor 11 are arranged on the guide path 1. A separation claw 20 is arranged at an end of the guide path 1, i.e., arranged at a point where the upper conveying path 2 and the lower conveying path 3 are branched from the guide path 1. The separation claw 20 rotates to switch a conveying direction of the sheet P between the upper conveying path 2 and the lower conveying path 3.

A conveying roller 21, a discharge sensor 22, a discharging roller 23, and a shifting roller 24 are arranged on the upper conveying path 2. The sheet P that is not conveyed to the lower conveying path 3 is delivered along the upper conveying path 2, and discharged to the catch tray 4. The discharged sheet P is sequentially stacked on the catch tray 4.

A rotatable filler 51 is arranged above a discharge opening of the sheet post-processing apparatus A. An end of the filler 51 is in contact with a point near the center of the upper surface of the uppermost sheet P stacked on the catch tray 4.

A first upper-surface detecting sensor 52 and a second upper-surface detecting sensor 53 are arranged near a base portion of the filler 51. The first upper-surface detecting sensor 52 and the second upper-surface detecting sensor 53 detect the end of the filler 51, thereby detecting the level of the upper surface of the uppermost sheet P stacked on the catch tray 4.

The first upper-surface detecting sensor 52 and the second upper-surface detecting sensor 53 are arranged in such a manner that the base portion of the filler 51 is vertically sandwiched therebetween. The base portion of the filler 51 is positioned in the middle between the first upper-surface detecting sensor 52 and the second upper-surface detecting sensor 53, i.e., both the first upper-surface detecting sensor 52 and the second upper-surface detecting sensor 53 are OFF. The second upper-surface detecting sensor 53 is used to detect the level of the upper surface of the uppermost one of the sheets P that are stacked on the catch tray 4 passed through the upper conveying path 2 without passing through the lower conveying path 3. A position near the second upper-surface detecting sensor 53, i.e., a position at which the second upper-surface detecting sensor 53 is switched from ON to OFF is set to a home position of the base portion of the filler 51.

When the number of the sheets P stacked on the catch tray 4 increases, i.e., the level of the upper surface of the uppermost sheet P becomes higher, the second upper-surface detecting sensor 53 is turned ON. The control unit then controls a driving unit (not shown) to move down the catch tray 4. The driving unit is configured to move the catch tray 4 up and down.

When the catch tray 4 moves down, and the second upper-surface detecting sensor 53 is turned OFF, the control unit stops the catch tray 4 from moving down. This operation is repeatedly performed. When the catch tray 4 reaches a predetermined level at which the catch tray 4 is full of the stacked sheets P, the sheet post-processing apparatus A feeds a stop signal to the image forming apparatus B, thereby stopping the image forming system from performing the image forming operation.

Lower conveying rollers 30, an ejection sensor 31, and an ejecting roller 32 are arranged on the lower conveying path 3. A stapling unit 5 is arranged at the end of the lower conveying path 3, and includes a stapler S1 and a staple tray 34. The stapler S1 for stapling an end portion of a pile of the sheets P moves forward and backward in a direction orthogonal to the conveying direction of the sheet P. The staple tray 34 stacks thereon the sheets P to be discharged.

The stapling unit 5 further includes a jogger fence unit 36 including jogger fences 36*a* and 36*b* (see, FIG. 2), a tapping roller 37, a discharging belt 38, a discharging claw 38*a*, a rear-end fence unit 39 including rear-end fences 39*a* and 39*b* (see, FIG. 2), and a rear-end presser 40. The jogger fence unit 36 moves forward and backward in a direction orthogonal to the conveying direction of the sheet P to align the sheets P stacked on the staple tray 34. The rear-end presser 40 moves forward and backward in the thickness direction of the sheet P.

As described above, because the stapling unit 5 includes the staple tray 34, the discharging belt 38, and the discharging claw 38*a*, the stapling unit 5 functions also as a discharging unit. A movable fence unit 42 shown in FIG. 1 includes movable fences 42*a* and 42*b* (see, FIG. 2).

When the sheet post-processing apparatus A receives a staple mode signal for stapling an end portion of the pile from the image forming apparatus B, the stapler S1 moves in the direction orthogonal to the conveying direction of the sheet P to an appropriate position of the lower portion of the pile and then stands by at that position. When the sheet P is conveyed along the lower conveying path 3, the sheet P is ejected to the staple tray 34 by the ejecting roller 32, and is tapped at the upper surface thereof by the tapping roller 37, so that the sheets P are aligned in the longitudinal direction.

The sheets P are aligned in the width direction by the jogger fence unit 36. When the sheet P is put into the rear-end fence unit 39, the rear-end presser 40 presses the rear end of the sheet P against the staple tray 34, so that a subsequent sheet can be easily put into the rear-end fence unit 39.

After the predetermined number of sheets P is stacked and aligned on the staple tray 34, the stapler S1 moves from the standby position to a stapling position, and staples the sheets P at the stapling position. The pile of the stapled sheets P is delivered along the discharging belt 38 in a counterclockwise direction while the lower edge of the pile is supported by the discharging claw 38*a*. In this manner, the pile is moved upward, and then discharged to the catch tray 4.

In a stapling mode, the first upper-surface detecting sensor 52 is used to detect the level of the upper surface of the uppermost sheet P. A position near the first upper-surface detecting sensor 52, i.e., a position at which the first upper-surface detecting sensor 52 is switched from OFF to ON is set to a home position of the base portion of the filler 51.

As described above, when the number of the sheets P stacked on the catch tray 4 increases, i.e., the level of the upper surface of the uppermost sheet P becomes higher, the first upper-surface detecting sensor 52 is turned OFF. The control unit then controls the driving unit to move down the catch tray 4.

When the catch tray 4 moves down, and the first upper-surface detecting sensor 52 is turned ON, the control unit stops the catch tray 4 from moving down. This operation is repeatedly performed. When the catch tray 4 reaches a predetermined level at which the catch tray 4 is full of the stacked sheets P, the sheet post-processing apparatus A feeds a stop signal to the image forming apparatus B, thereby stopping the image forming system from performing the image forming operation.

Figure 2:
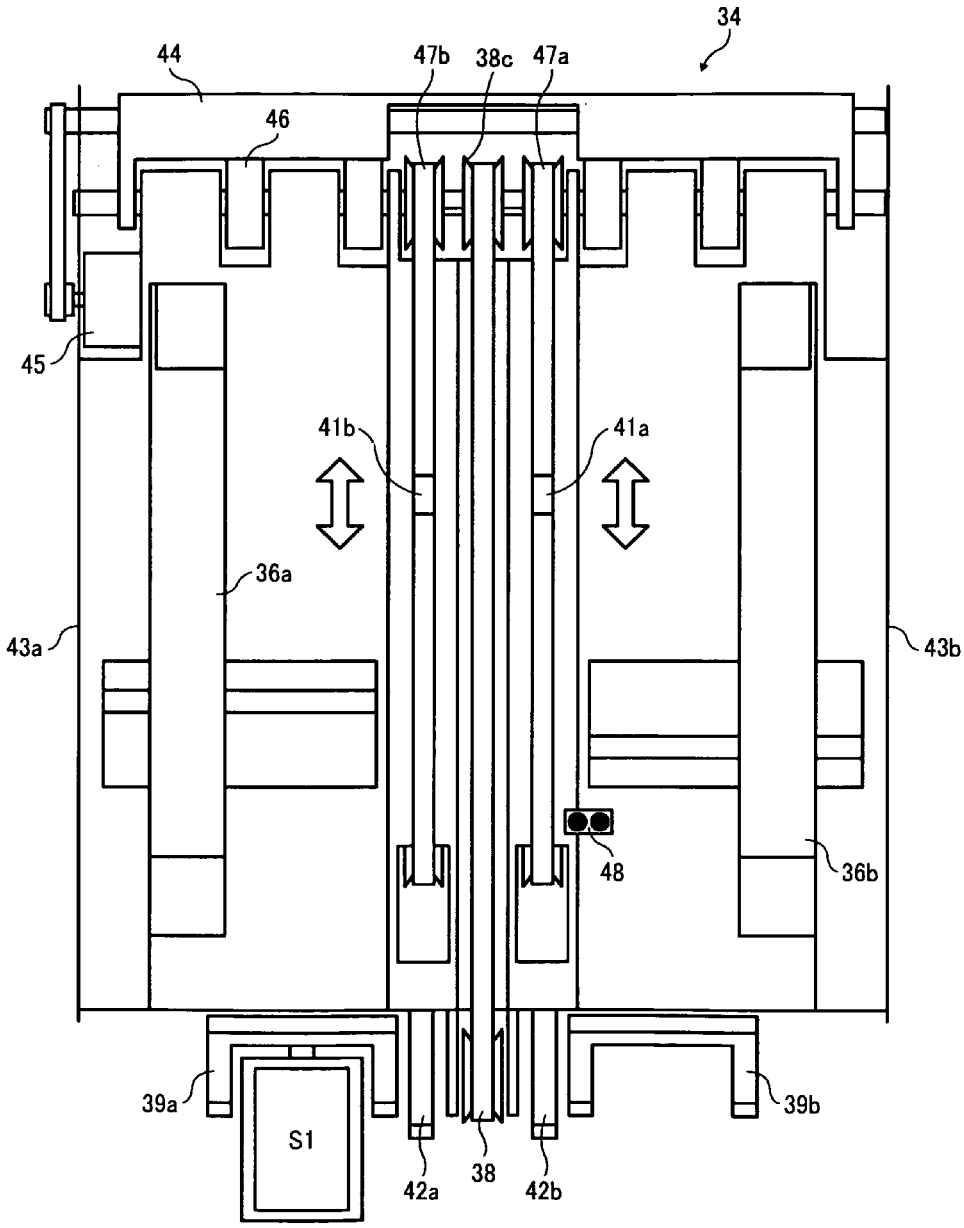
FIG. 2 is a schematic diagram of a staple tray of the sheet post-processing apparatus seen in a direction perpendicular to a surface of the staple tray on which a sheet is conveyed.

FIG. 2 is a schematic diagram of the staple tray 34 seen in the direction perpendicular to the surface of the staple tray 34 on which the sheet P is conveyed.

When the sheet post-processing apparatus A receives the sheets P from the image forming apparatus B that is an upstream apparatus, the sheets P are aligned in the width direction by the jogger fences 36*a* and 36*b* and in the longitudinal direction by an end stopper unit 41 that includes end stoppers 41*a* and 41*b* putting the sheets P in contact with the rear-end fences 39*a* and 39*b*.

After the alignment of the sheets P is completed, the stapler S1 staples the sheets P. The pile of the stapled sheets S1 is moved up by the movable fences 42*a* and 42*b*. Each of the movable fences 42*a* and 42*b* and the rear-end fences 39*a* and 39*b* includes a receiving member (not shown) that receives the sheet P. The receiving members of the movable fences 42*a* and 42*b* are located in a slightly lower position than the receiving members of the rear-end fences 39*a* and 39*b*. With this configuration, the receiving members of the movable fences 42*a* and 42*b* do not interfere with the sheets P when the end stoppers 41*a* and 41*b* align the sheets P in the longitudinal direction by putting the sheets P in contact with the rear-end fences 39*a* and 39*b*.

As described above, because the rear-end fences 39*a* and 39*b* are arranged in a position lower than the lower portion of the staple tray 34, it is possible to prevent misalignment of the sheets P. The movable fences 42*a* and 42*b* are arranged as a mechanism of moving up the pile of the sheets P to an operating range of the discharging claw 38*a* in which the discharging claw 38*a* can receive the sheets P from the movable fence unit 42 and scoop up the received sheets P.

After the pile of the sheets P is moved up by the movable fences 42*a* and 42*b*, the discharging belt 38 rotates in the counterclockwise direction in FIG. 1, and the discharging claw 38*a* attached to the discharging belt 38 receives the pile of sheets P from the movable fences 42*a* and 42*b*. The discharging claw 38*a* then discharges the pile out of the staple tray 34.

It should be noted that the above-described operation can be performed on unstapled sheets on which the stapling process is not performed after the alignment process is finished. As shown in FIG. 2, the staple tray 34 further includes a pulley 38*c* that rotates the discharging belt 38, a front side plate 43*a*, a back side plate 43*b*, a movable guide 44, a pile-separation drive motor 45, a discharging roller 46, conveying belts 47*a* and 47*b*, and a sheet presence sensor 48.

Figure 3:
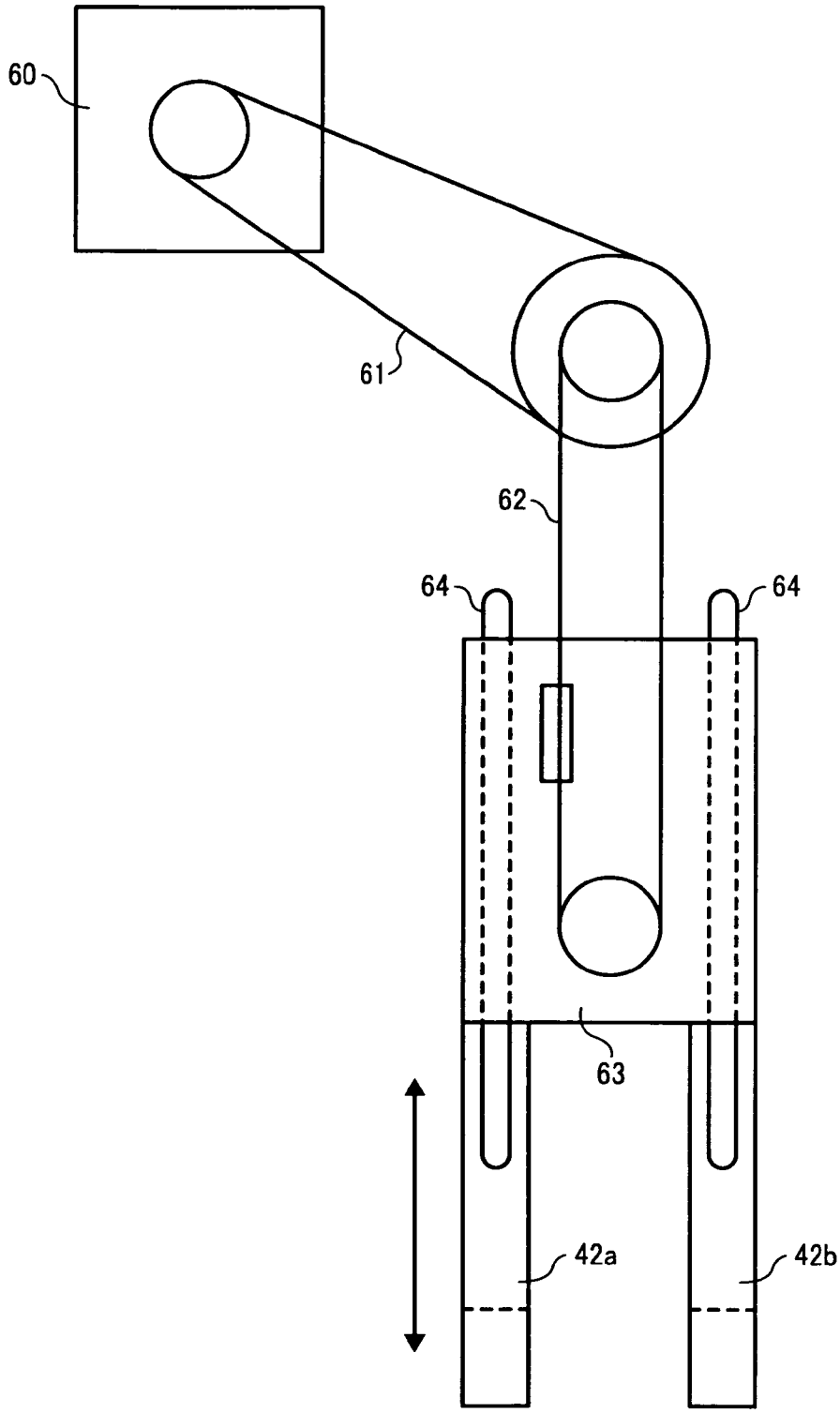
FIG. 3 is a schematic diagram for explaining a relation between movable fences and a drive motor of the sheet post-processing apparatus.

FIG. 3 is a schematic diagram for explaining a relation between the movable fences 42*a* and 42*b* and a drive motor 60 that drives the movable fences 42*a* and 42*b*.

When the drive motor 60 drives a slider 63 through belts 61 and 62, the slider 63 slides up and down along supporting rods 64, so that the movable fences 42*a* and 42*b* attached to the slider 63 are moved up and down.

Figure 4:
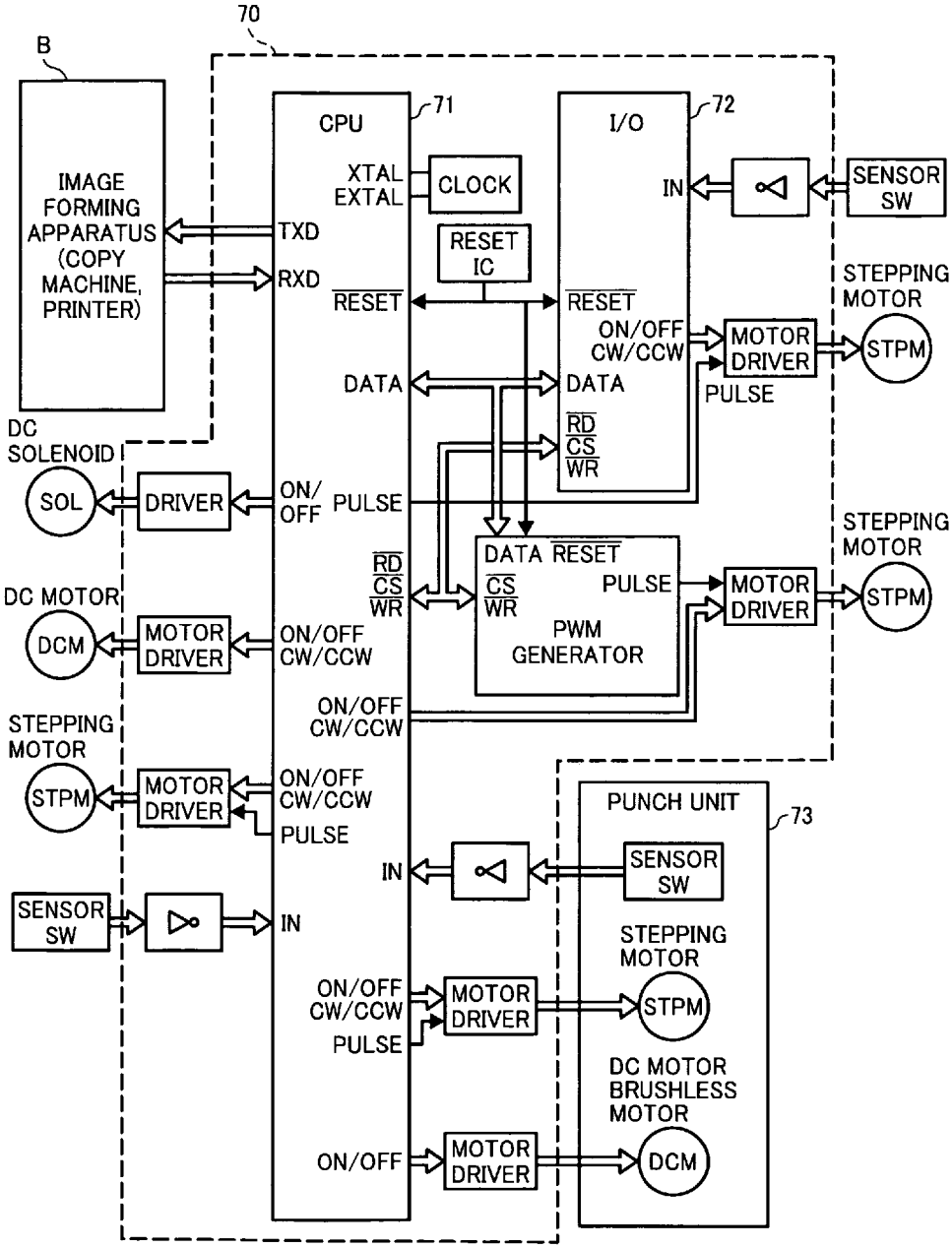
FIG. 4 is a block diagram of a control circuit of the sheet post-processing apparatus.

FIG. 4 is a block diagram of a control circuit 70 of the sheet post-processing apparatus A according to the embodiment.

The control circuit 70 is also a control circuit of the image forming apparatus B, and includes a microcomputer having a central processing unit (CPU) 71, an input/output (I/O) interface 72, or the like. A detailed description on the control of respective members of the image forming apparatus B is omitted.

A signal is fed from a punch unit 73, a switch of a control panel (not shown) included in a main body of the image forming apparatus B, and a sensor such as a sheet-surface detecting sensor, to the CPU 71 via the I/O interface 72.

The CPU 71 controls based on an input signal a motor (not shown) for shifting a shift tray (not shown), a motor (not shown) for opening and closing a discharge guide plate (not shown), a motor for moving the shift tray, a motor (not shown) for driving the tapping roller 37 (FIG. 1), a solenoid (SOL) such as a tapping SOL (not shown), a motor (not shown) for driving the conveying roller, and a motor (not shown) for driving the discharging roller.

The CPU 71 also controls motors, such as a motor (not shown) for driving the discharging belt 38 (FIG. 1), a motor (not shown) for moving the stapler S1 (FIG. 2), a motor (not shown) for rotating the stapler S1 in an oblique direction, a motor (not shown) for moving the jogger fences 36*a* and 36*b* (FIG. 2), the pile-separation drive motor 45 (FIG. 2) for rotating the movable guide 44, and a motor (not shown) for driving the conveying roller that conveys the pile.

Furthermore, the CPU 71 controls a motor (not shown) for moving the movable fences 42*a* and 42*b* (FIG. 2), a motor (not shown) for moving a folding plate (not shown), a motor (not shown) for driving a folding roller (not shown), and the like.

A pulse signal for driving a stapled-sheet conveying motor (not shown) that drives a stapled-sheet discharging roller (not shown) is input to the CPU 71, and the input pulse signal is counted by the CPU 71. The tapping SOL and the motor for moving the jogger fences 36*a* and 36*b* are controlled based on the counted pulse signal.

Figure 5:
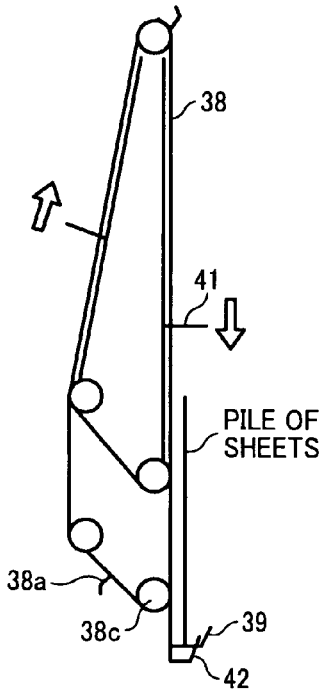
FIGS. 5 to 7 are schematic diagrams for explaining positional relations between an end stopper unit, a discharging claw, a rear-end fence unit, and the movable fence unit of the sheet post-processing apparatus.
Figure 6:
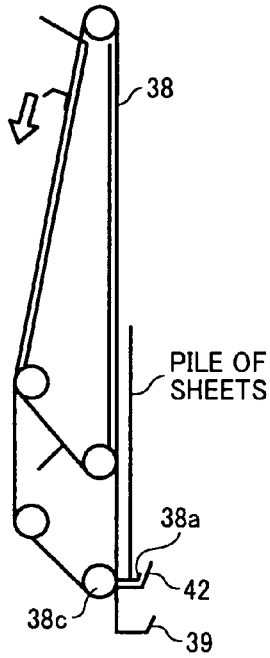
Figure 7:
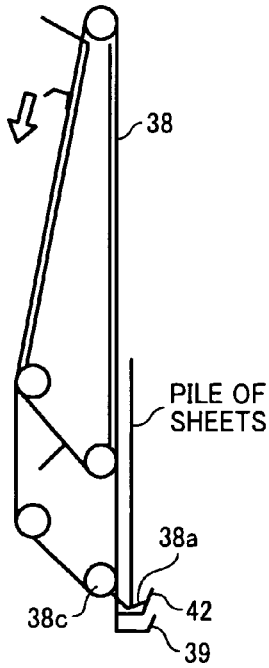

FIGS. 5 to 7 are schematic diagrams for explaining three different positional relations between the end stopper unit 41, the discharging claw 38*a*, the rear-end fence unit 39, and the movable fence unit 42.

The number of the sheets P that have been conveyed to and aligned on the staple tray 34 is counted by the CPU 71 of the sheet post-processing apparatus A, or is obtained based on data received from the image forming apparatus B.

Subsequently, it is determined whether the number of the sheets P is large, i.e., a high load can be applied to the discharging claw 38*a* when the sheets P are discharged. As shown in FIG. 6, if it is determined that the high load can be applied to the discharging claw 38*a*, i.e., the number of sheets P is equal to or more than the predetermined number, the discharging claw 38*a* receives the sheets P from the movable fence unit 42 when the movable fence unit 42 reaches the height of the center of the pulley 38*c*.

For this configuration, a linear speed and driving timing of each of the motors is controlled such that a linear speed V1 at which the movable fence unit 42 moves becomes slower than a liner speed V2 at which the discharging claw 38*a* moves (first mode). Afterward, the discharging claw 38*a* continues to move up, and discharges the sheets P out of the sheet post-processing apparatus A. The movable fence unit 42 stops moving up, and moves down to a standby position.

As described above, when the number of sheets P is large, i.e., the high load can be applied to the discharging claw 38*a* when the discharging claw 38*a* scoops up the pile of the sheets P, the discharging claw 38*a* receives the sheets P at the most stable point, and discharges the sheets P in a steady manner. Thus, the sheet post-processing apparatus A with high reliability can be provided.

When the number of sheets P is small, i.e., a low load can be applied to the discharging claw 38*a* when the discharging claw 38*a* scoops up the pile of the sheets P, timing at which the movable fence unit 42 delivers the sheets P to the discharging claw 38*a* is controlled.

Specifically, as shown in FIG. 7, a linear speed and drive timing of each of the movable fence unit 42 and the discharging claw 38*a* are controlled in such a manner that the discharging claw 38*a* receives the pile from the movable fence unit 42 at the lowest position within the operating range (second mode).

As described above, the discharging claw 38*a* receives the sheets P from the movable fence unit 42 when the movable fence unit 42 moves up to the lowest position within the operating range of the discharging claw 38*a*. Thus, a time required for discharging the sheets P can be shortened, and the productivity can be improved.

In the first mode, when the discharging claw 38*a* receives the sheets P from the movable fence unit 42, the discharging claw 38*a* is positioned perpendicular to the edge of the pile. In this manner, the discharging claw 38*a* can receive the pile with the pile being in contact near the inner edge of the discharging claw 38*a*, and therefore the discharging claw 38*a* can discharge the pile in a steady manner.

However, in the first mode, the movable fence unit 42 needs to move to the height of the center of the pulley 38*c*. Therefore, it spends longer time from the alignment of the sheets P to the discharge of the aligned sheets P.

In the second mode, it is possible to shorten such a time. However, when the discharging claw 38*a* receives the sheets P from the movable fence unit 42, the discharging claw 38*a* is not positioned perpendicular to the edge of the pile.

Specifically, as shown in FIG. 7, the discharging claw 38*a* receives the sheets P from the movable fence unit 42 with the pile being in contact with the outer edge, not the inner edge. Therefore, when the number of the sheets P is large, the discharging claw 38*a* scoops up the pile of the sheets P by supporting only the lower layer portion of the pile. As a result, the discharging claw 38*a* cannot scoop up the upper layer portion of the pile. Alternatively, when the number of the sheets P is large, the discharging claw 38*a* cannot withstand the load applied thereto, resulting in step-out of a discharging motor (not shown).

Therefore, in the embodiment, an operation mode of discharging the pile is switched based on a condition of the sheets P to be discharged, so that both the reliability and the productivity can be improved.

The load applied to the discharging claw 38*a* during the operation of discharging the sheets P depends on the number of sheets P, and the size and the thickness of the sheet P. Therefore, preferably, every time the sheet post-processing apparatus A receives the sheets P from the image forming apparatus B, the sheet post-processing apparatus A detects or receives information on the sheet P from the image forming apparatus B. In this manner, the discharge of the sheets P is controlled as appropriate.

Figure 8:
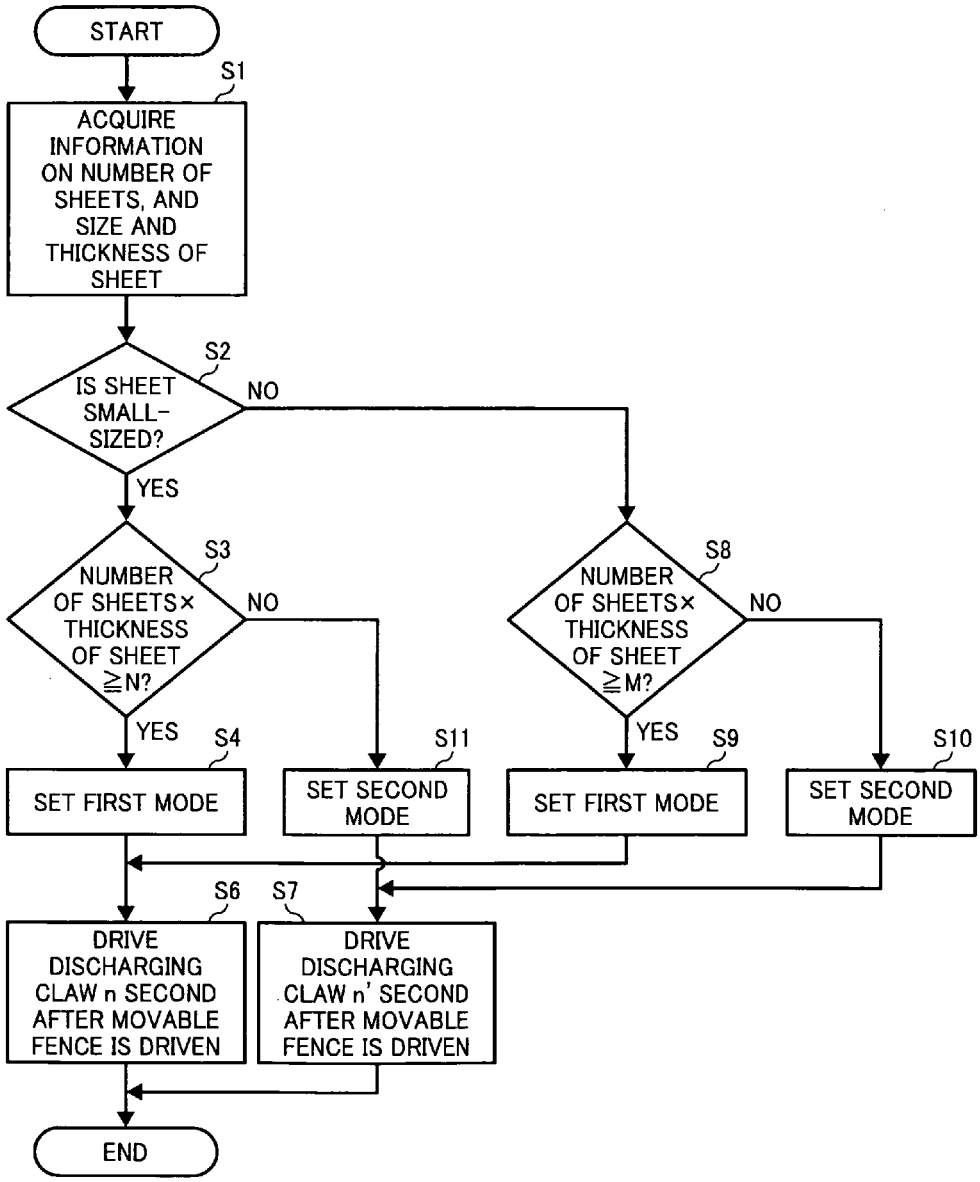
FIG. 8 is a flowchart of a control process performed by the sheet post-processing apparatus.

FIG. 8 is a flowchart of the control process performed by the sheet post-processing apparatus A. Values indicated by the words "small size", "M", "N", "n", "n'" are determined based on a fixed value that is obtained by an experiment and assessment.

In the embodiment, the timing at which the discharging claw 38*a* receives the sheets P from the movable fence unit 42 is controlled, and a point at which the discharging claw 38*a* receives the sheets P from the movable fence unit 42 is switched depending on a weight of the pile. If the discharging claw 38*a* receives a heavy pile from the movable fence unit 42 at the lower position, the discharging claw 38*a* cannot withstand the load applied thereto. As a result, the discharging claw 38*a* cannot discharge the pile.

On the contrary, if the weight of the pile is light, the discharging claw 38*a* can withstand the load applied thereto. Therefore, the discharging claw 38*a* receives the pile from the movable fence unit 42 at the lower position, so that the productivity can be improved. Thus, the weight of the pile is determined depending on the number of the sheets P, and the size and the thickness of the sheet P, and the position at which the discharging claw 38*a* receives the pile from the movable fence unit 42 is controlled by using a period between a time at which the movable fence unit 42 starts moving and a time at which the discharging claw 38*a* starts moving.

As shown in FIG. 8, information about the stapled sheets P, such as the number of the sheets P, the size and the thickness of the sheet P, is acquired from a control unit (not shown) of the image forming apparatus B (Step S1). It is determined whether the size of the sheet P is small (Step S2). If the size of the sheet P is small (Yes at Step S2), it is determined whether a value obtained by multiplying the number of the sheets P by the thickness of the sheet P is equal to or larger than N (the number of the sheets P×the thickness of the sheet P≧N) (Step S3). If the value is equal to or larger than N (Yes at Step S3), the first mode is set (Step S4). The discharging claw 38*a* (FIG. 5) is then driven n second after the movable fence unit 42 is driven (FIG. 5) (Step S6). If the value is smaller than N (No at Step S3), the second mode is set (Step S11). The discharging claw 38*a* is then driven n' second after the movable fence unit 42 is driven (Step S7).

If the size of the sheet P is not small (No at Step S2), it is determined whether a value obtained by multiplying the number of the sheets P by the thickness of the sheet P is equal to or larger than M (the number of the sheets P×the thickness of the sheet P≧M) (Step S8). If the value is equal to or larger than M (Yes at Step S8), the first mode is set (Step S9). The discharging claw 38*a* is then driven n second after the movable fence unit 42 is driven (Step S6).

If the value is smaller than M (No at Step S8), the second mode is set (Step S10). The discharging claw 38*a* is then driven n' second after the movable fence unit 42 is driven (Step S7).

As described above, in the embodiment, it is determined whether the load applied to the discharging claw 38*a* when the pile is discharged is high or low depending on the number of the sheets P, and the size and the thickness of the sheet P. When the load applied to the discharging claw 38*a* is high, the discharging claw 38*a* receives the pile at the point where the pile can be discharged in a steady manner. When the load applied to the discharging claw 38*a* is low, the discharging claw 38*a* receives the pile at the point where the pile can be discharged in a shorter time. Thus, the reliability and the productivity of the sheet post-processing can be improved.

Furthermore, an image forming (processing) apparatus and an image forming (processing) system to which the sheet post-processing apparatus A is applied can provide improved reliability and productivity in the above sheet post-processing operation.

Figure 9:
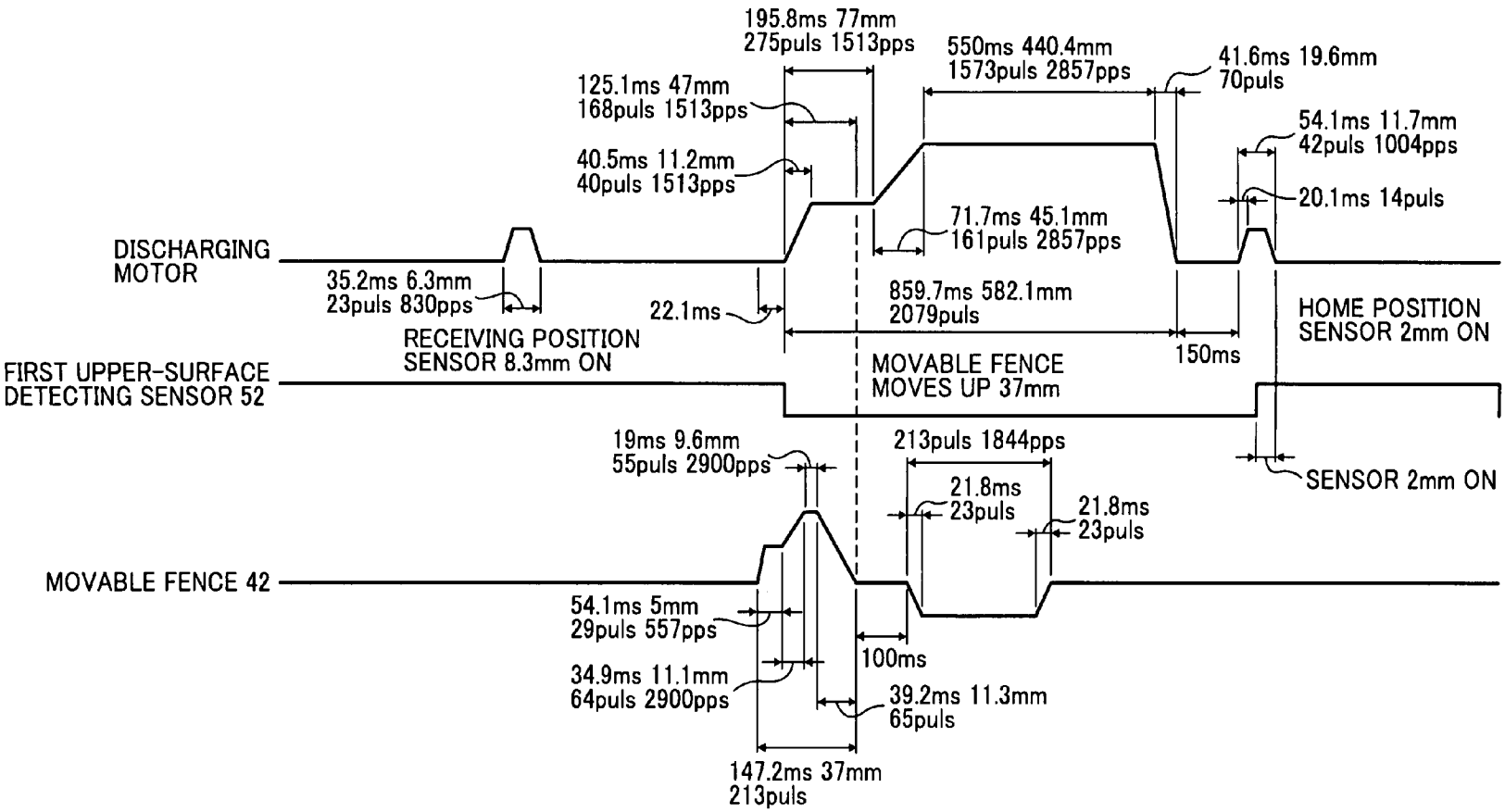
FIG. 9 is a timing chart for explaining another pattern for discharging a pile of sheets.

FIG. 9 is a timing chart for explaining another pattern for discharging the pile of the sheets P. The above-described pattern is referred to as "first pattern", and the pattern described below is referred to as "second pattern". In the second pattern, when the discharging claw 38*a* receives the pile from the movable fence unit 42, a discharging motor (not shown) operates at a low speed. After the discharging claw 38*a* receives the pile from the movable fence 42, the discharging motor increases its driving linear speed to a predetermined driving linear speed to scoop and discharge the pile.

The number of the sheets P that have been conveyed to and aligned on the staple tray 34 (FIG. 2) is counted by the CPU (FIG. 4), or is obtained based on data received from the image forming apparatus B.

When it is determined that the number of the sheets P is equal to or more than the predetermined number, i.e., the high load can be applied to the discharging claw 38*a*, the linear speed of the motor decreases to a low level to obtain a higher torque. The discharging claw 38*a* receives the pile from the movable fence unit 42 with the motor at the low linear-speed level. After that, the linear speed of the motor increases to a level for discharging the pile.

When it is determined that the number of the sheets P is less than the predetermined number, the discharging claw 38*a* receives the pile from the movable fence unit 42 at the linear speed that is the same as that for discharging the pile, and discharges the received pile, in the same manner as described in the first patter.

The driving linear speed of the motor for discharging the pile is determined and changed depending on the size of the sheet P and the number of the stapled sheets P. Specifically, it is determined whether the sheet P is small-sized or large-sized. Then, a linear speed v1 for discharging the small-sized sheet P and a linear speed v2 for discharging the large-sized sheet P are determined in such a manner that the relation v1>v2 is satisfied.

If the sheet P is large-sized, it is determined whether the number of the large-sized sheets P is equal to or more than the predetermined number, or less than the predetermined number. Then, a linear speed v2 for discharging the sheets P larger than the predetermined number and a linear speed v3 for discharging the sheets P smaller than the predetermined number are determined in such a manner that the relation v2<v3 is satisfied.

As described above, when the number of sheets P is large, i.e., the high load can be applied to the discharging claw 38*a*, a torque of the discharging motor is increased when the discharging claw 38*a* receives the pile from the movable fence unit 42. Therefore, it is possible to prevent step-out of the discharging motor. Thus, the reliability can be improved.

According to an aspect of the present invention, the discharging claw receives the pile of the sheets from the movable fence at the point where the discharging claw receives the pile in a stable manner with the highest sheet-retention ability. Therefore, even if the number of sheets is large, i.e., the high load can be applied to the discharging claw, the pile can be discharged in a steady manner. Thus, the sheet post-processing apparatus can be provided with higher reliability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing apparatus comprising:

a sheet stacking unit that receives a plurality of sheets from an upstream apparatus and stacks the sheets in a pile thereon;

a moving member that moves up the pile stacked on the sheet stacking unit to one of a plurality of scooping positions; and a discharging member that receives the pile from the moving member at the one of the scooping positions and scoops up the pile by supporting a bottom edge of the pile for discharging the pile out of the sheet stacking unit, wherein the scooping position at which the discharging member receives the pile from the moving member is switched based on a predetermined condition being satisfied.

2. The sheet post-processing apparatus according to claim 1, further comprising a control unit that switches a plurality of operation modes depending on the predetermined condition of the pile to be discharged.

3. The sheet post-processing apparatus according to claim 2, wherein the control unit causes the discharging member to receive the pile from the moving member while the moving member is moving up.

4. The sheet post-processing apparatus according to claim 2, wherein the control unit variably controls start timing and a speed at which the discharging member moves.

5. The sheet post-processing apparatus according to claim 2, wherein after the discharging member receives the pile at the scooping position, the control unit makes a speed at which the discharging member moves faster than a speed at which the moving member moves.

6. The sheet post-processing apparatus according to claim 1, wherein the discharging member includes a pulley, and the discharging member receives the pile from the moving member at a scooping position where the pulley is in contact with the moving member.

7. The sheet post-processing apparatus according to claim 1, wherein when the pile meets the predetermined condition, the discharging member receives the pile from the moving member at a scooping position where the moving member starts moving up within a range in which the discharging member is capable of scooping the pile.

8. The sheet post-processing apparatus according to claim 7, wherein the predetermined condition is number of sheets contained in the pile.

9. The sheet post-processing apparatus according to claim 7, wherein the predetermined condition is a thickness of the pile.

10. The sheet post-processing apparatus according to claim 7, wherein the predetermined condition is a size of the sheets contained in the pile.

11. The sheet post-processing apparatus according to claim 1, further comprising a movable stopper unit that aligns the pile against a rear fence.

12. The sheet post-processing apparatus according to claim 1, wherein the moving member moves the pile from a first position to a second position remote from the first position and the discharging member receives the pile at the second position.

13. The sheet post-processing apparatus according to claim 1, wherein sheet stacking unit is a staple tray and a position of receipt of the pile by the discharging member from the moving member varies along a length of the staple tray.

14. An image forming apparatus that is configured to be attached to a sheet post-processing apparatus, the sheet post-processing apparatus includes a sheet stacking unit that receives a plurality of sheets from an upstream apparatus and stacks the sheets in a pile thereon;

a moving member that moves up the pile stacked on the sheet stacking unit to one of a plurality of scooping positions; and a discharging member that receives the pile from the moving member at the one of the scooping positions and scoops up the pile by supporting a bottom edge of the pile for discharging the pile out of the sheet stacking unit, wherein the scooping position at which the discharging member receives the pile from the moving member is switched based on a condition being satisfied.

15. An image forming system comprising:

a sheet post-processing apparatus that includes a sheet stacking unit that receives a plurality of sheets from an upstream apparatus and stacks the sheets in a pile thereon, a moving member that moves up the pile stacked on the sheet stacking unit to one of a plurality of scooping positions, and a discharging member that receives the pile from the moving member at the one of the scooping positions and scoops up the pile by supporting a bottom edge of the pile for discharging the pile out of the sheet stacking unit, wherein the scooping position at which the discharin member receives the pile from the moving member is switched based on a condition being satisfied; and an image forming apparatus that is configured to be attached to the sheet post-processing apparatus.

* * * * *